US005806681A

United States Patent [19]

Frisk

[11] Patent Number: 5,806,681

[45] Date of Patent: Sep. 15, 1998

[54] ARTICLE FOR SCAVENGING OXYGEN FROM A CONTAINER

[75] Inventor: Peter Frisk, Chicago, Ill.

[73] Assignee: Tetra Laval Holdings & Finance, S.A., Pully, Switzerland

[21] Appl. No.: 729,221

[22] Filed: Oct. 9, 1996

[51] Int. Cl.[6] ..... B65D 81/02; B65D 39/00

[52] U.S. Cl. ..... 206/524.3; 215/228; 206/524.6; 252/181.1

[58] Field of Search ..... 252/181.1; 215/228; 206/524.3, 524.6

[56] References Cited

U.S. PATENT DOCUMENTS

| | | | |
|---|---|---|---|
| 4,188,457 | 2/1980 | Throp | 428/542 |
| 4,211,681 | 7/1980 | Braun et al. | 524/109 |
| 4,279,350 | 7/1981 | King | 215/228 |
| 4,287,995 | 9/1981 | Moriya | 215/228 |
| 4,350,508 | 9/1982 | Santoro et al. | 55/275 |
| 4,756,436 | 7/1988 | Morita et al. | 215/228 |
| 4,834,234 | 5/1989 | Sacherer et al. | 206/204 |
| 4,840,280 | 6/1989 | Schvester | 215/228 |
| 5,064,698 | 11/1991 | Courtright | 428/35.4 |
| 5,183,848 | 2/1993 | Samuel et al. | 525/57 |
| 5,186,991 | 2/1993 | Samuel et al. | 428/35.8 |
| 5,362,531 | 11/1994 | Samuel et al. | 428/36.6 |
| 5,663,223 | 9/1997 | Teumac et al. | 524/109 |

*Primary Examiner*—C. H. Kelly
*Attorney, Agent, or Firm*—Michael A. Catania

[57] ABSTRACT

An article composed of a polymer material integrated with an oxygen scavenging agent is disclosed that is suitable for oxygen sensitive contents. Once affixed to the interior of a container, the novel article is capable of scavenging excess oxygen from the enclosed atmosphere of the container without substantially modifying the design of similar container. The article is composed of a polymer material integrated with an oxygen scavenging agent between 0.1 and 1.0 grams. One aspect of the article is a thin film which only surrounds the atmosphere of the container. In most container configurations, the article would be the neck portion of the container. Another aspect of the article is a thin film affixed to the bottom of a sealing cap for the container. The polymer material may be a polyolefin such as polyethylene. The oxygen scavenging agent may be selected from iron based compounds, organic compounds and biologically active compounds. More specifically, the iron based compounds may be selected from pure iron, iron containing organic compounds, $FeO_X$, and $Fe_XO_Z(OH)_T$. The organic compounds used as oxygen scavenging agents may be selected from ascorbic acid, vitamin E, vitamin B and most other vitamins. The article is in direct contact with the gaseous contents of the atmosphere of the container. The present invention also discloses a method for fabricating an oxygen scavenging container.

3 Claims, 3 Drawing Sheets

ARTICLE FOR SCAVENGING OXYGEN FROM A CONTAINER

TECHNICAL FIELD

The present invention relates to an article composed of a polymer material integrated with an oxygen scavenging agent. Specifically, the present invention relates to an article for scavenging oxygen from a container wherein the article is composed of a polyolefin material integrated with an oxygen scavenging agent.

BACKGROUND

In the packaging industry, the permeability of containers to oxygen has been the motivating factor for a number of inventions. Excess oxygen in a container for a food product will eventually lead to the degradation of the food product. For example, excess oxygen in a wine container will lead to the oxidation of the wine which will result in the formation of acetic acid, vinegar, thereby destroying the value of the intended food product, wine. Other oxidation reactions are equally destructive to a plethora of food products which provides the motivation for those in the industry to invent different methods to overcome the problem with oxygen permeability. One method has been to prevent the ingress of oxygen into the packaging by creating packaging materials with enhanced impermeability which substantially, but not entirely, prevent the ingress of oxygen into the container. Another method has been to remove the oxygen once it has entered the container through use of an oxygen scavenger.

Various techniques have been developed to scavenge oxygen from containers using an assortment of scavenging agents. One such technique is to place the oxygen scavenging agent into one layer of the packaging material, then cover this scavenging layer with a oxygen permeable layer thereby preventing contact between the scavenging layer and the contents while allowing for the removal of oxygen from the container. Farrell et al, U.S. Pat. No. 4,536,409, for an Oxygen Scavenger, discloses such a technique. In Farrell et al, a polymeric layer containing the oxygen scavenger agent is matched with a permeable protective layer thereby permitting removal of the oxygen without having any direct contact between the contents and the oxygen scavenging layer. Speer et al, U.S. Pat. No. 5,350,622, for a Multilayer Structure For A Package For Scavenging Oxygen also discloses a container for food which includes a barrier layer, a oxygen scavenging layer, and an innermost permeable layer which prevents contact between the contents and the oxygen scavenger. Although these inventions have the ability to scavenge oxygen from a container, they also increase the number of layers for the container to prevent contact between the scavenging agent and the contents.

Most containers for food products are not completely filled, thereby creating a space for the gaseous contents to reside when the container is sealed. Due to its partial pressure, oxygen prefers the gaseous state and will migrate from the solid or liquid phase contents to this space inadvertently created for the gaseous contents. In a bottle, this space would encompass the neck of the bottle and the space immediately below the neck. Therefore, the oxygen scavenging agent should also be located in the neck of the bottle since the majority of the excess oxygen will reside in this space.

Several inventions have come forth which attempt to take advantage of oxygen's preference for the gaseous state. Schvester, U.S. Pat. No. 4,840,280, for a Sealing Cap For Liquid Food Or Beverage Containers discloses a sealing cap for a container for a liquid contents having a sealed bag containing the scavenging agent wherein in the sealed bag is placed within the permeable layers of the cap. In this manner, Schvester attempts to scavenge oxygen from a container. Morita et al, U.S. Pat. No. 4,756,436, for a Oxygen Scavenger Container Used For Cap also discloses a cap for a container for a liquid contents which has an oxygen scavenger placed within a number of permeable layers. These caps, similar to the above-mentioned packaging materials, disclose a cap composed of a multitude of layers which increase the size and costs of the caps, and also add to the complexity of the fabrication process.

The foregoing patents, although efficacious in the scavenging of oxygen, are not the denouement of the problems of excess oxygen in containers. There are still unresolved problems which compel the enlargement of inventions in the scavenging of excess oxygen from containers.

SUMMARY OF THE INVENTION

The present invention enlarges the scope of scavenging excess oxygen from containers by providing an approach to this problem which does not increase the number of layers of a container, nor does it increase the complexity of the fabrication process. The present invention is able to accomplish this by providing a novel article composed of a polymeric material integrated with an oxygen scavenging agent and designed for contact with the gaseous contents of a container.

One aspect of the present invention is an article for the substantial scavenging of excess oxygen from a container. The container may have an atmosphere composed of gaseous contents in addition to a primary contents. The article comprises an oxygen scavenging agent of between 0.1 and 1.0 grams, integrated into a polymer material. The article is in direct contact with substantially only the atmosphere of the container and the article is affixable to the interior of the container. The oxygen scavenging agent may be selected from the group consisting of an iron based compound, an organic compound, a biologically active compound and any mixture thereof. If the oxygen scavenging agent is an iron based compound, then it may be selected from the group consisting $FeO_X$, pure iron, an iron containing organic compound and $Fe_xO_y(OH)_z$. If the oxygen scavenging agent is an organic compound, then it may be selected from the group consisting of ascorbic acid, vitamin E and vitamin B. The oxygen scavenging agent may also be activated by exposure to a relatively high humidity environment.

The polymeric material may be a polyolefin. The article may be a thin film affixed to the interior surface of a sealing cap for the container. Further, the article may be a thin film affixed to a section of the container which substantially encompasses the atmosphere of the container. The article may be in direct content with the gaseous contents of the container. The primary contents of the container may be a flowable food product such as a beverage. The container may have a bottle shape and the article may be affixed to a neck portion of the bottle.

Another aspect of the present invention is a container for flowable food products having an article therein capable of scavenging excess oxygen from an atmosphere of the container. In this aspect, the article comprises an oxygen scavenging agent of between 0.1 and 1.0 grams, integrated into a polymer material. The article is in direct contact with substantially only the atmosphere of the container and the article is affixable to a portion of the container. The oxygen scavenging agent may be selected from the group consisting of an iron based compound, an organic compound, a biologically active compound and any mixture thereof. If the oxygen scavenging agent is an iron based compound, then it may be selected from the group consisting $FeO_X$, pure iron, an iron containing organic compound and $Fe_xO_y(OH)_z$. If the oxygen scavenging agent is an organic compound, then it may be selected from the group consisting of ascorbic acid, vitamin E and vitamin B. The oxygen scavenging agent may also be activated by exposure to a relatively high humidity environment.

The polymeric material may be a polyolefin such as polyethylene. The polymeric material may also be selected from the group consisting of polyethylene terephthalate ("PET"), copolymer of polyethylene terephthalate ("COPET") and a mixture thereof. The article may be a thin film affixed to the interior surface of a sealing cap for the container. Further, the article may be a thin film affixed to a section of the container which substantially encompasses the atmosphere of the container. The primary contents of the container may be a flowable food product such as a beverage. The container may have a bottle shape and the article may be affixed to a neck portion of the bottle.

Still another aspect of the present invention is a method for producing a container for flowable food products having an article therein capable of scavenging excess oxygen from an atmosphere of the container. The article is composed of a polymer material integrated with an oxygen scavenging agent of approximately between 0.1 and 1.0 grams. The container is produced in accordance with a method comprising the following steps. First, one integrates the oxygen scavenging agent into the polymer material through compounding to form a modified polymer material. Next, one fabricates a thin film from the modified polymer material. Finally, one affixes the thin film to the container as an article to substantially scavenge oxygen from the atmosphere of the container. The article may be selected from the group consisting of a thin film affixed to a section of the container which encompasses the atmosphere of the container and a thin film affixed to the interior surface of a sealing cap for the container.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE DRAWINGS

Several features of the present invention are further described in connection with the accompanying drawings in which:

There is illustrated in FIG. I a cross-section side view of one embodiment of the article of the present invention affixed to a container.

Figure 2:
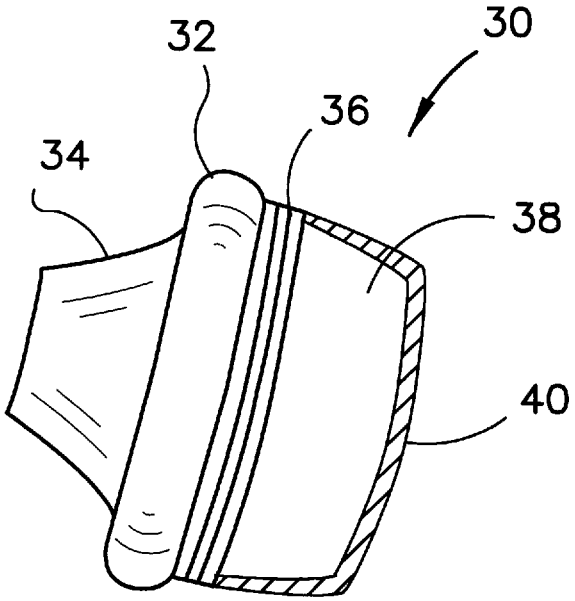

There is illustrated in FIG. 2 a side view of one embodiment of the article of the present invention affixed to a sealing cap for a container.

Figure 3:
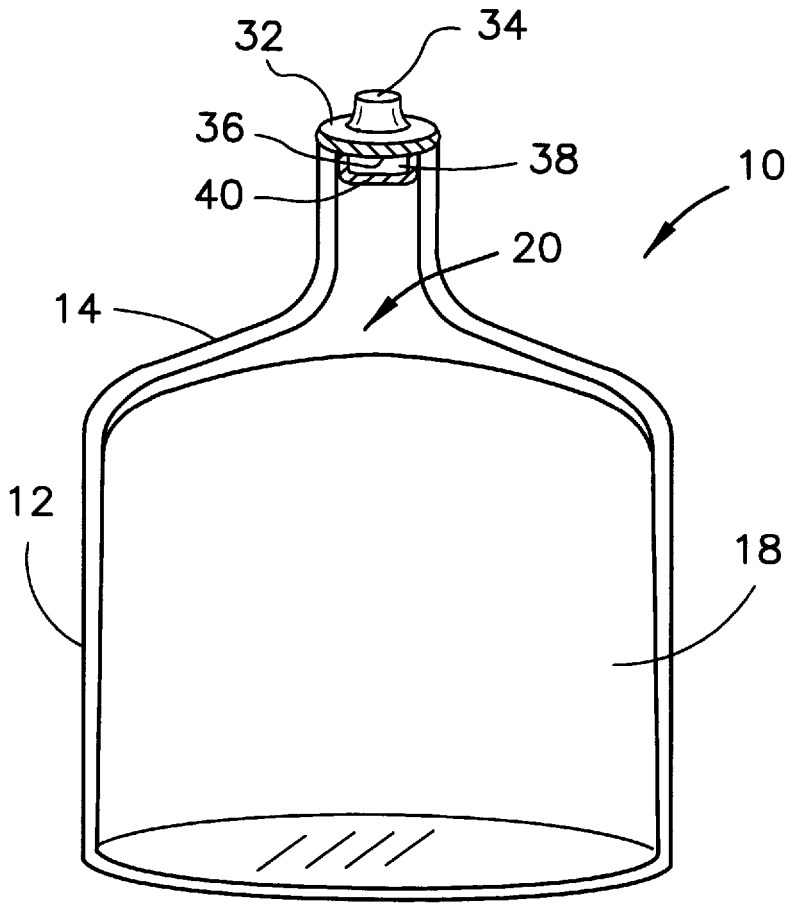

There is illustrated in FIG. 3 a partial cross-section view of a container with the sealing cap of FIG. 2 positioned therein.

DETAILED DESCRIPTION OF THE PREFERRED EMBODIMENTS

Containers for flowable food products such as fruit juices, alcoholic beverages, soups and the like usually provide for an "atmosphere" in the sealed container. This atmosphere, which is composed of gaseous contents, usually lies above the primary contents of the container and serves several purposes. One purpose may be to reduce the amount of the primary contents of the container as a costs saving measure to the manufacturer. Another purpose may be to serve as a safety measure to accommodate variations in pressure the container may undergo during distribution. Still another purpose may be to provide the consumer with a container which will not spill its contents during the opening of the container. Although this atmosphere may serve many purposes, it may also present problems for the manufacturers. One such problem pertains to excess oxygen in the container. Excess in that the oxygen is not needed by the contents of the container and in fact is most likely detrimental to the contents of the contain. The article of the present invention is designed to remove the excess oxygen from the atmosphere of the container in a novel manner which does not greatly increase the costs or complexity of fabricating containers for flowable food products.

The article of the present invention is composed of a modified polymeric material which is capable of scavenging excess oxygen from the atmosphere of the container. The modified polymeric material is integrated with an oxygen scavenging agent. The oxygen scavenging agent is integrated with polyolefin material before the modified polymeric material is converted into a container configuration such as a bottle. One of the novel aspects of the present invention is the minimal amount of an oxygen scavenging agent necessary to effectively remove excess oxygen from the atmosphere of the container. The present invention only requires a minimal amount of oxygen scavenging agent since only the upper portion of the container which surrounds the atmosphere is actually the residence of the excess oxygen. This upper portion of the container, sometimes referred to as the "headspace," is where oxygen prefers to reside in the container due to the partial pressure of oxygen. Therefore, by taking advantage of oxygen's preference for the gaseous state, the present invention only requires a minimal amount of oxygen scavenging agent to effectively prevent the oxidation of the primary contents of the container.

The oxygen scavenging agent is integrated with the polymeric material in an amount of approximately 0.1 to 1.0 grams. The oxygen scavenging material may be selected from one or more materials including: an organic compound; an iron-based compound; and/or a biologically active compound. The iron-based compound may include $FeO_x$, pure iron, iron containing organic compound and $Fe_xO_y(OH)_z$. The use of iron-based compounds allow the oxygen scavenging agent to be humidity activated at a time prior to or concurrent with the filling of the container. For example, subsequent to the fabrication of the container, the container may be stored indefinitely in a relatively low humidity environment. Then, prior to or concurrent with the filling process, the container may be exposed to a relatively high humidity environment for a predetermined time period sufficient for the activation of the oxygen scavenging agent. A further, iron based oxygen scavenging compound suitable for use in the present invention is OXYGUARD which is available from Toyo Seikan Kaisha of Yokahama, Japan.

Various organic compounds which are well known by those skilled in the pertinent art may be utilized as oxygen scavenging agents for the present invention. For example, ground sea grass and/or ground tea leaves may be suitable for use as an oxygen scavenging agent for the present invention. Also, a rice extract, such as disclosed in Tokuyama et al, U.S. Pat. No. 5,346,697, for an Active Oxygen Scavenger, may be utilized as an oxygen scavenging agent for the present invention. Further, most vitamins may be used as oxygen scavenging agents in practicing the present invention. Specifically, an ascorbic acid (vitamin C), a vitamin B or a vitamin E compound may be used as oxygen scavenging agents in practicing the present invention.

Monomers and short chain polymers of, for example, polypropylene and/or polyethylene are likewise organic compounds which are suitable as oxygen scavenging agents for utilization in practicing the present invention. If a short chain polymer is utilized, selective activation of the oxygen scavenger agent is possible by irradiating the modified polymeric material with, for example, ultraviolet light or with electron beam emissions. Such irradiation effects a cutting of the inter-monomer bonds thereby creating even shorted, and more chemically active, polymer chains and monomers. If acceleration of the oxygen scavenging process is desirable, a mixture of both organic compounds and iron-based compounds may be integrated into the polymeric material which in a preferred embodiment is polyolefin. However, the polymeric material may be a PET, COPET or a mixture thereof.

Figure 1:
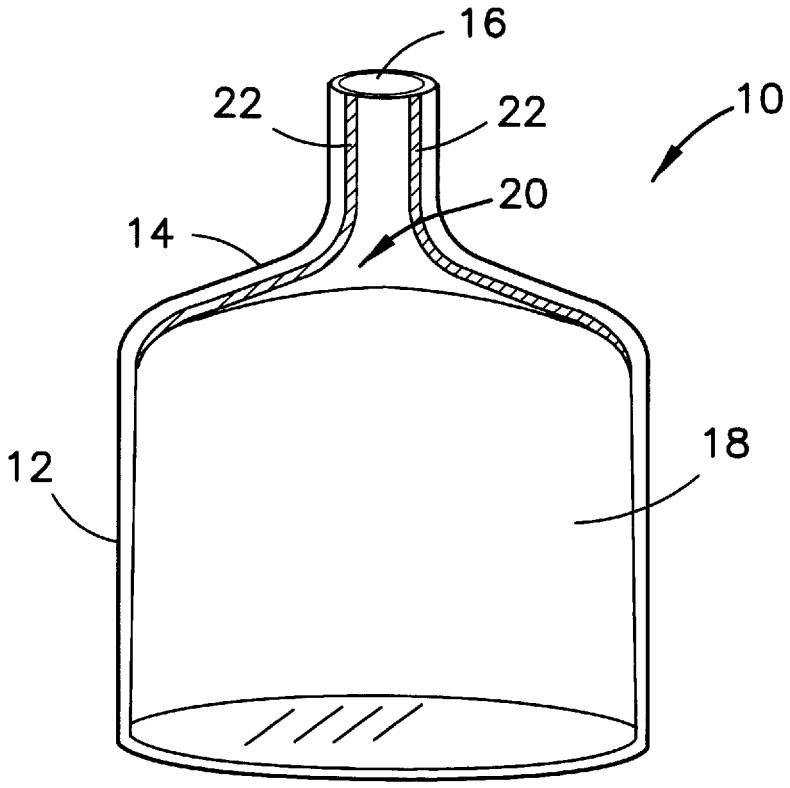

There is illustrated in FIG. 1 a cross-section side view of one embodiment of the article of the present invention affixed to a container. As shown in FIG. 1, a container is generally designated 10. Although the container 10 is in the shape of a bottle, such shape is for illustration purposes and is not intended to limit the possible configurations that the present invention may be utilized in conjunction with to scavenge oxygen from a container. The container 10 consists of a lower portion 12 and an upper portion 14. The container 10 also has an opening 16 located at the top of the container 10.

The lower portion 12 generally encompasses the area filled by a primary contents of the container 10. The primary contents 18 may be a liquid such as a carbonated beverage, water, fruit juice and the like. The primary contents 18 may also be a solid such as a granular spice. Further, the primary contents may be a combination of a liquid and a solid such as a soup or yogurt. The lower portion 12 is composed of a polymer material which is substantially unreactive with the primary contents 18 of the container 10. The lower portion 12 may be composed of PET, COPET or some mixture thereof. However, alternative embodiments may have a modified PET, COPET or mixture thereof which enhances the inherent properties of such materials.

The upper portion 14 generally encompasses a gaseous contents 20 of the container 10. In the bottle configuration illustrated in FIG. 1, the upper portion 14 is the neck portion of the bottle. The gaseous contents 20 will most likely be gases entrapped in the container 10 after sealing of the opening 16 and gases permeating from the primary contents 18. The gaseous contents 20 may also be gases which permeated through the container 10 from either the lower portion 12 or the upper portion 14. The gaseous contents 20 will predominantly include oxygen, carbon dioxide, nitrogen and water vapor. In this embodiment, the article of the present invention is a thin film 22 which encompasses the upper portion 14 of the container. The thin film 22 is composed of a modified polymer material which is capable of a scavenging oxygen from the gaseous contents 20 thereby reducing the possibility that the oxygen will adversely react with the primary contents 18. The modified polymer material has an integrated oxygen scavenging agent which binds with any excess oxygen thereby removing it from the gaseous contents 20.

The thin film 22 is affixed above the primary contents 18 to minimize the contact between the primary contents 18 and the oxygen scavenging agent integrated into the polymer material of the thin film 22. The size of the upper portion 14 and lower portion 12 will be dependent on the size and shape of the container 10, and the level to which the primary contents 18 is filled within the container 10. This will have a direct effect on the size and shape of the thin film 22.

The thin film 22 is affixed to the upper portion 14 of a pre-fabricated container 10. The thin film 22 may be affixed to the container 10 using several well-known methods. One of these methods is heat sealing wherein the pre-positioned thin film 22 and the upper portion 14 of the container 10 are exposed to a predetermined temperature sufficient to cause the adhesion of the thin film 22 to the upper portion 14. Although the article of the present invention has been described in reference to a particular container shape, those skilled in the art will recognize that other container shapes may be employed without departing from the scope of the present invention.

There is illustrated in FIG. 2 a side view of one embodiment of the article of the present invention affixed to a sealing cap for a container. There is illustrated in FIG. 3 a partial cross-section view of a container with the sealing cap of FIG. 2 positioned therein. As shown in FIGS. 2 and 3, the sealing cap is generally designated 30 and is composed of an external lid 32, a turnknob 34, internal threading 36 and an internal projection 38. In this embodiment, the article of the present invention is a thin film 40 which is affixed to the internal projection 38 of the sealing cap 30.

As previously mentioned, the thin film 40 is composed of a modified polymer material which is capable of a scavenging oxygen from the gaseous contents 20 thereby reducing the possibility that the oxygen will adversely react with the primary contents 18. The modified polymer material has an integrated oxygen scavenging agent which binds with any excess oxygen thereby removing it from the gaseous contents 20. The thin film 40 is designed to substantially not interfere with the sealing and removal of the sealing cap 30 from the container 10. The sealing cap 30 is positioned in a container 10 to hermetically seal the container 10. Although the article of the present invention has been described in reference to a particular sealing cap, those skilled in the art will recognize that other sealing caps may be employed without departing from the scope of the present invention.

Compounding

The article of the present invention is a polymeric material integrated with an oxygen scavenging agent of approximately between 0.1 and 1.0 grams. The polymeric material may be a polyolefin or the like. A preferred polyolefin is a polyethylene material. The oxygen scavenging agents are described above, and generally consists of iron-based compounds, organic compounds and biological compounds. These oxygen scavenging agent may be integrated into the polymeric material through various methods well known in the pertinent art. One particularly useful method for integration of the oxygen scavenging agents into the polymeric material is compounding.

Compounding is a process by which ingredients are intimately melt-mixed together into as nearly a homogeneous mass as is possible. An extensive description of compounding is provided in chapter 22 of Plastics Engineering Handbook of the Society of the Plastics Industry, Fifth Edition, Van Nostrand Reinhold 1991, which also provides extensive information on plastics in general. There are several methods of compounding which employ several devices such as single-screw extruders, continuous mixers, intensive dry mixers, pelletizers and twin-screw extruders. A preferred method of compounding is through twin-screw extruders.

In twin screw extruders, the two screws are arranged side by side incorporating a design of co-rotating screws that are intermeshing and self-wiping. Because the screws rotate in the same direction, the polyolefin material moves helically along the inside barrel wall in a figure-eight path from the feed stein to the discharge point.

The geometry of the screw components is such that the root of one screw is constantly wiped by the flight tip of the second screw, with a uniformly small clearance between them at every point. Thus, dead spots are eliminated, the residence of each melt is uniform, and purging times are shortened. Because of the positive conveyance of the material in a twin-screw extruder, the molten polyolefin material and oxygen scavenging agents are efficiently conveyed, irrespective of friction coefficients. With positive conveying, operation with partially filled screw flights is possible while degassing is going on in some zones, or additional components are introduced into others.

Screw configurations are used to vary conveying efficiency, throughput rate, the degree of filling, and pressure buildup. Screws with reversed flights are used to generate localized high pressure. Hydraulically operated dynamic valves between barrel sections can be used to allow pressure variations during operation. Staggered stepped screws provide intensive transversal mixing by shear forces of varying intensity. Various mixing and kneading effects are obtained by suitable screw design.

The residence time is determined by the barrel length, screw lead, screw speed, and throughput rate. The residence time may vary between twenty seconds and ten minutes, depending on the process and operating conditions. Residence time distribution may be influenced by changing the screw geometry, by which the residence time distribution can be widened to handle considerable longitudinal mixing.

Selective removal of heat from the melt by cooled screws and barrel walls results in increased melt viscosity and, consequently, in higher shear rates. The need for external heating can be minimized by appropriate screw geometry. Depending on the product and the process, the specific input energy may be varied between 0.05 and 1.2 kWh/kg.

The modified polymeric material in the barrel is worked into thin layers by relatively narrow screw flights. The design increases the processing intensity, particularly at the barrel crest, where the modified polymeric material transfers from one screw to the other, and the layers are continuously mixed and inverted.

Volatiles are removed through vent ports at different locations along the barrel length. Fluids or melts of high or low viscosity or free-flowing solids may be introduced into the barrel at various points by means of suitable measuring devices.

Twin-screw extruders with counter-rotating screws also are available and, despite similarities to the co-rotating screw types, there are some significant differences in the way they handle the melt.

With counter-rotating screws, screw flights carry the modified polymeric material by friction in such a direction that all of it is forced toward the point where the two screws meet, there forming a bank of the modified polymeric material similar to that of a two-roll mill, although some material slips through the gap between the two screws. As with the two-roll mill, the theory is to feed the modified polymeric material through the nip from the bank on top of the nip gradually and statistically, in order that each particle be processed equally over a period of time.

Counter-rotating twin-screws can put the modified polymeric material passing through the nip under an extremely high degree of shear, in the manner of a two-roll mill. Varying the clearance between the screws varies the portion of material fed between the screws against the portion of material accumulated in the bank and simply moving down the barrel. Modified polymeric material passing through the nip can be subjected to great shear forces by narrowing the clearance, and the portion of material in the bank also is greater.

Statistically, however, only a portion of the material is subjected to the high-shear condition of the nip, and only a portion to the low-shear condition of the bank. Counter-rotating twin-screws are not totally self-cleaning.

In co-rotating twin-screws, one screw transports the material around up to the point on intermeshing, where, because of the existence of two opposing and equal velocity gradients, a great majority of the material is transferred from one screw to the other along the entire barrel length in the figure-eight path mentioned earlier. Because the figure-eight path is relatively long, the chances of controlling the melt temperature are much better with this design.

The amount of shear energy developed at the point of defection can be regulated within very wide limits by choosing the depths of the screw flights. Self-cleaning screws, aside from the obvious advantage of facilitating color change, provide control over residence time also is of great importance for heat-sensitive resins and pigments, or for operating at higher processing temperatures. A short and uniform residence time is essential to minimize heat and shear history, and, thereby, to maximize quality.

Although compounding has been described as a preferred method of integrating the oxygen scavenging agent into the polymeric material, those skilled in the art will recognize that many other methods are applicable to the integration of the oxygen scavenging agent into polymeric material without departing from the scope of the present invention.

Industrial Applicability

The present invention is most applicable to the prevention of oxidation of flowable food products such as beverages. The article of the present invention may be affixed a portion of a container encompassing an atmosphere of the container prior to the filling of the container with a desired contents. Alternatively, the article of the present invention may be affixed to a sealing cap of the container which is sealed on the container subsequent to the filling of the container with a desired contents. In either form, the present invention is capable of scavenging oxygen from the atmosphere of the container thereby preventing, or at a minimum substantially decreasing the degradation of the contents.

The present invention is able to accomplish its purpose of scavenging excess oxygen from a closed container with only a minimal amount of oxygen scavenging agent since the article of the present invention is in direct contact with the gaseous contents of a closed container. Although the article is in direct contact with gaseous contents, the oxygen scavenging agent does not present an additional hazard to the primary contents of the container since the agent is integrated into a polymer material, and the article is not in constant contact with the primary contents since the article is disposed,in the region of the gaseous contents.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

I claim as my invention:

1. A bottle for containing a liquid food product, the bottle having an opening at the top and an enclosed bottom, the bottle having an atmosphere present when filled with the liquid food product, the bottle comprising:

a continuous interior wall of the bottle extending from the opening to the bottom, the continuous interior wall having an upper portion surrounding the atmosphere of the bottle and nearest the opening of the bottle and a lower portion contiguous with the upper portion, the lower portion surrounding the liquid food product and nearest the bottom of the bottle; and a polyolefin film integrated with an oxygen scavenging agent, the polyolefin film affixed to the upper portion of the continuous interior wall and in direct contact with the atmosphere of the bottle, the oxygen scavenging agent present in an amount between 0.1 and 1.0 gram, and the oxygen scavenging agent selected from the group of pure iron, iron oxide, and iron containing organic compounds;

whereby the oxygen scavenging agent degrades oxygen present in the atmosphere of the bottle without continuous contact with the liquid food product.

2. A PET bottle for containing a liquid food product, the PET bottle having an opening at the top and an enclosed bottom, the bottle having an atmosphere present when filled with the liquid food product, the bottle comprising:

a continuous interior wall of the PET bottle extending from the opening to the bottom, the continuous interior wall having an upper portion surrounding the atmosphere of the bottle and nearest the opening of the bottle and a lower portion contiguous with the upper portion, the lower portion surrounding the liquid food product and nearest the bottom of the PET bottle; and a polyolefin film integrated with an oxygen scavenging agent, the polyolefin film affixed to the upper portion of the continuous interior wall and in direct contact with the atmosphere of the bottle, the oxygen scavenging agent present in an amount between 0.1 and 1.0 gram, and the oxygen scavenging agent selected from the group of pure iron, iron oxide, and iron containing organic compounds;

whereby the oxygen scavenging agent degrades oxygen present in the atmosphere of the PET bottle without continuous contact with the liquid food product.

3. The combination of a bottle for containing a liquid food product and a sealing cap for the bottle, the bottle having an opening at the top for placement of the sealing cap therein and an enclosed bottom, the bottle having an atmosphere present when filled with liquid food product, the sealing cap comprising a body with an exterior top and an interior bottom, the interior bottom sized to fit tightly within the opening of the bottle and having an interior surface with a polyolefin film affixed thereon and in direct contact with the atmosphere of the bottle, the polyolefin film integrated with an oxygen scavenging agent present in an amount between 0.1 and 1.0 gram, and the oxygen scavenging agent selected from the group of pure iron, iron oxide, and iron containing organic compounds; whereby the oxygen scavenging agent degrades oxygen present in the atmosphere of the bottle without continuous contact with the liquid food product.

* * * * *